United States Patent [19]

Tam et al.

[11] Patent Number: 4,496,642

[45] Date of Patent: Jan. 29, 1985

[54] OVERCOATED MIGRATION IMAGING SYSTEM

[75] Inventors: Man C. Tam; Gregory J. Kovacs, both of Mississauga, Canada

[73] Assignee: Xerox Corporation, Stamford, Conn.

[21] Appl. No.: 493,914

[22] Filed: May 12, 1983

[51] Int. Cl.[3] ..... G03G 5/00; G03G 5/14

[52] U.S. Cl. ..... 430/41; 430/66; 430/67; 430/127; 430/132

[58] Field of Search ..... 430/41, 66, 67, 127, 430/132

[56] References Cited

U.S. PATENT DOCUMENTS

| | | | |
|---|---|---|---|
| 3,849,128 | 11/1974 | Ihara | 430/132 |
| 3,901,702 | 8/1975 | Sankus et al. | 430/41 |
| 3,909,262 | 9/1975 | Goffe et al. | 430/41 |
| 3,948,657 | 4/1976 | Yoshikawa et al. | 430/67 X |
| 4,256,823 | 3/1981 | Takahashi et al. | 430/67 X |
| 4,281,050 | 7/1981 | Buckley et al. | 430/41 |

OTHER PUBLICATIONS

Buckley et al., "Fixing and Abrasion Resistance of Liquid Developed Migration Images", Jour. Appl. Photo. Ener., vol. 5, No. 2, Spring 1979, pp. 89-92.

*Primary Examiner*—Roland E. Martin

*Attorney, Agent, or Firm*—Peter H. Kondo; John E. Beck; Ronald Zibelli

[57] ABSTRACT

An imaging member comprising a substrate, an electrically insulating swellable, softenable layer on the substrate, the softenable layer having particulate migration marking material located at least at or near the surface of the softenable layer spaced from the substrate, and a protective overcoating comprising a film-forming resin, a portion of which extends beneath the surface of the softenable layer. This migration imaging member may be prepared with the aid of a material which swells at least the surface of the softenable layer to allow the film-forming resin to penetrate beneath the surface of the softenable layer.

9 Claims, 7 Drawing Figures

OVERCOATED MIGRATION IMAGING SYSTEM

BACKGROUND OF THE INVENTION

This invention relates generally to migration imaging, and more specifically to an overcoated migration imaging member and the process for preparing the member.

Migration imaging systems capable of producing high quality images of high density, continuous tone and high resolution, have been developed. Such migration imaging systems are disclosed, for example, in U.S. Pat. No. 3,909,262 which issued Sept. 30, 1975, the disclosure of which is incorporated herein in its entirety. In a typical embodiment of migration imaging systems, an imaging member comprising a substrate, a layer of softenable material, and photosensitive marking material is imaged by first forming a latent image by electrically charging the member and exposing the charged member to a pattern of activating electromagnetic radiation such as light. Where the photosensitive marking material was originally in the form of a fracturable layer contiguous the upper surface of the softenable layer, the marking particles in the exposed area of the member migrate toward the substrate when the member is developed by softening the softenable layer.

The expression "softenable" as used herein is intended to mean any material which can be rendered more permeable thereby enabling particles to migrate through its bulk. Conventionally, changing the permeability of such material or reducing its resistance to migration of migration marking material is accomplished by dissolving, melting, and softening, by techniques, for example, such as contacting with heat, vapors, partial solvents, solvent vapors, solvents and combinations thereof, or by otherwise reducing the viscosity of the softenable material by any suitable means.

The expression "fracturable" layer or material as used herein, means any layer or material which is capable of breaking up during development, thereby permitting portions of said layer to migrate toward the substrate or to be otherwise removed. The fracturable layer may be particulate, semi-continuous, or microscopically discontinuous in various embodiments of the migration imaging members of the present invention. Such fracturable layers of marking material are typically contiguous to the surface of the softenable layer spaced apart from the substrate, and such fracturable layers may be substantially embedded in the softenable layer in various embodiments of the imaging members of the inventive system.

The expression "contiguous" as used herein is intended to mean in actual contact; touching; also, near, though not in contact; and adjoining, and is intended to generically describe the relationship of the fracturable layer of marking material in the softenable layer, vis-a-vis, the surface of the softenable layer spaced apart from the substrate.

There are various other systems for forming such images, where non-photosensitive or inert marking materials are arranged in the aforementioned fracturable layers, or dispersed throughout the softenable layer, as described in the aforementioned patent, which also discloses a variety of methods which may be used to form latent images upon migration imaging members.

Various means for developing the latent images in the novel migration imaging system may be used. These development methods include solvent wash-away, solvent vapor softening, heat softening, and combinations of these methods, as well as any other method which changes the resistance of the softenable material to the migration of particulate marking material through the softenable layer to allow imagewise migration of the particles toward the substrate. In the solvent wash-away or meniscus development method, the migration marking material migrates in imagewise configuration toward the substrate through the softenable layer, which is softened and dissolved, leaving an image of migrated particles corresponding to the desired image pattern on the substrate, with the material of the softenable layer substantially or partially completely washed away. Various methods and materials and combinations thereof have previously been used to fix such unfixed migration images. In the heat, or vapor softening developing modes, the softenable layer is softened to allow imagewise migration of marking material toward the substrate and the developed image member generally comprises the substrate having migrated marking particles nearer the softenable layer substrate interface with the softenable layer and unmigrated marking materials intact on the substrate in substantially their original condition.

The background portions of an imaged member may be transparentized by means of an agglomeration effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and the softenable layer softened by exposure for a few seconds to a solvent vapor thereby causing a selective migration of the migration material in the softenable layer in the areas which were previously exposed to the activating radiation. The vapor developed image is then subjected to a heating step causing the migration material in unexposed areas to agglomerate or flocculate, often accompanied by fusion of the marking material particles, thereby resulting in a very low background image. Alternatively, the migration image may be formed by heat followed by exposure to solvent vapors and a second heating step which results in background reduction. In this imaging system as well as in the previously described heat or vapor development techniques, the softenable layer remains substantially intact after development, with the image being self-fixed because the marking material particles are trapped within the softenable layer.

Generally, the softenable layer of migration imaging members is characterized by sensitivity to abrasion and foreign contaminants. Since a fracturable layer is located at or close to the surface of the softenable layer, abrasion can readily remove some of the fracturable layer and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other.

The sensitivity to abrasion and foreign contaminants can be reduced by forming an overcoating such as the overcoatings described in the aforementioned U.S. Pat. No. 3,909,262. However, because the migration imaging mechanisms depend critically on the electrical properties of the surface of the softenable layer and on the complex interplay of the various electrical processes involving charge injection from the surface, charge transport through the softenable layer, charge capture by the photosensitive particles and charge ejection from the photosensitive particles etc., application of an overcoat to the softenable layer often causes changes in the delicate balance of these processes, and results in degraded photographic characteristics compared with the non-overcoated migration imaging member. Notably, the photographic contrast density is degraded. Contrast density is the difference between maximum optical density and minimum optical density of an image. Optical density is measured by diffuse densitometers with a blue Wratten No. 94 filter. The expression "optical density" as used herein is intended to mean "transmission optical density" and is represented by the formula:

$$\log_{10}[I_o/I]$$

where I is the transmitted light intensity and $I_o$ is the incident light intensity. Using the high density film described in copending application D/82122, entitled "MULTISTAGE DEPOSITION PROCESS", filed in April 1983, in the names of Philip H. Soden and Paul S. Vincett, the entire disclosure of which is incorporated herein by reference, it has been found that the photographic characteristics and particularly the contrast density of the migration imaging member overcoated with the materials and prepared in accordance with the teaching described in the aforementioned U.S. Pat. No. 3,909,262 were greatly degraded when heat-developed. Recent experimental studies of the imaging mechanisms have been conducted by the technique of Thermally Stimulated Current (TSC). The technique of Thermally Stimulated Current is described, for example, in "Thermally Stimulated Discharge of Polymer Electrets" PhD. thesis, University of Leiden, 1972 and "Electrets, Charge Storage and Transport in Dielectrics", edited by M. M. Perlman, 1972, The Electrochemical Society, Inc. These Thermally Stimulated Current experimental studies in both the non-overcoated and overcoated migration imaging members have indicated that the loss of contrast density is due to trapping of the injected surface charge at the overcoat/softenable layer interface. Thus, during heat development, the migration imaging member is subject to the combined effects of a high field and a high temperature, which cause excessive thermally-activated conduction within the unexposed particles similar to the photoconductive process in the exposed particles. As a result, the discrimination (contrast density) between the light-struck and the dark regions is degraded. Moreover, many overcoats do not provide sufficient protection from abrasion and fingerprint contamination.

In addition, many overcoatings do not prevent blocking when migration imaging members are stacked or wound into rolls. In addition, for applications where migration imaging members are utilized for composing printing masters wherein imaged migration imaging members are temporarily secured by adhesive tape to a substrate and thereafter reused, very often the migration imaging member is damaged by removal of the adhesive tape and is rendered unsuitable for reuse. This damage generally takes two forms. First, many overcoats do not adhere well to the softenable layer of the migration imaging member and can be separated by flexing or easily separated or removed entirely from the softenable layer upon removal of the adhesive tape, thereby eliminating further abrasion resistance. Secondly, the softenable layer which contains the photoactive particles often separates from the conductive layer upon removal of the adhesive tape. Therefore, the overcoat should not only adhere well to the softenable layer but should also have abhesive properties to release the adhesive tape to prevent damage to the migration imaging member.

Also, it is a known fact that the charge life, i.e., the permissible time delay between charging and exposure before unacceptable degradation of sensitometric properties occurs, of non-overcoated migration imaging members is only about a few minutes for heat development. This is caused by the rapid dark decay of deposited negative corona charge on the surface of the softenable layer. Yet for many practical applications, it is necessary to extend the charge life of the migration imaging member.

While some of the above-described migration imaging members exhibit certain desirable properties such as resistance to abrasion and foreign contaminants, there continues to be a need for improved migration imaging members. Additionally, there is a need for improved migration imaging members which exhibit greater resistance to the adverse effects of finger prints, blocking, softenable layer/overcoating layer interface failure, and abrasion, can survive adhesive tape tests, and can be vapor or heat developed to provide essentially full contrast density.

SUMMARY OF THE INVENTION

It is an object of the present invention to provide an improved migration imaging member which overcomes the above-noted disadvantages.

It is yet another object of the present invention to provide an improved process for preparing a migration imaging member.

It is yet another object of the present invention to provide an improved migration imaging member having greater tolerance to abrasion.

It is yet another object of the present invention to provide an improved migration imaging member that minimizes blocking.

It is yet another object of the present invention to provide an improved migration imaging member that exhibits less sensitivity to finger prints.

It is yet another object of the present invention to provide an improved migration imaging member that provides essentially full contrast density with heat development by permitting facile charge transport during development through the overcoat and across the interface with the softenable layer.

It is yet another object of the present invention to provide an improved migration imaging member having surface release properties incorporated into the overcoating layer to impart anti-sticking properties to its outer surface.

It is yet another object of the present invention to provide an improved migration imaging member wherein the overcoating layer adheres strongly to the softenable layer.

It is yet another object of the present invention to provide an improved migration imaging member that survives adhesive tape removal.

It is yet another object of the present invention to provide an improved migration imaging member that provides essentially full contrast density with high density film upon heat development.

It is yet another object of the present invention to provide an improved migration imaging member that provides extended charge life for heat development.

These and other objects of the present invention are accomplished by providing an improved migration imaging member comprising a substrate, an electrically insulating, swellable, softenable layer on said substrate, the softenable layer having migration marking material located at least at or near the surface of the softenable layer spaced from the substrate, and a protective overcoating comprising a film forming resin, a part of which resides beneath the surface of said softenable material.

Also included within the scope of the present invention is a process for preparing a migration imaging member comprising providing a substrate, forming an electrically insulating, swellable, softenable layer on the substrate, the softenable layer having migration marking material located at least at or near the surface of the softenable layer opposite the substrate, and applying a protective overcoating forming mixture to the softenable layer, the protective overcoating forming mixture comprising a film forming resin and a material which swells at least the surface of the softenable layer whereby part of the film forming resin penetrates the surface of the softenable layer.

BRIEF DESCRIPTION OF THE DRAWINGS

For a better understanding of the present invention, and further features thereof, reference is made to the following detailed description of various preferred embodiments wherein.

These figures merely schematically illustrate the invention and are not intended to indicate relative size and dimensions of actual imaging members or components thereof.

DESCRIPTION OF THE PREFERRED EMBODIMENTS

Figure 1:
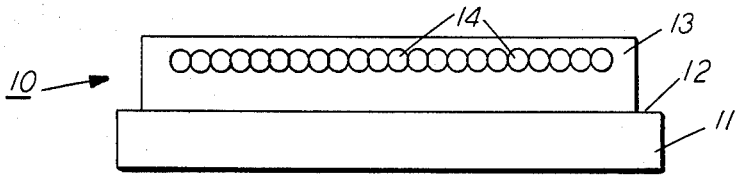
FIG. 1 is a partially schematic, cross-sectional view of a typical layered configuration migration imaging member.

Migration imaging members typically suitable for use in the migration imaging processes described above are illustrated in FIGS. 1 and 2. In the migration imaging member 10 illustrated in FIG. 1, the member comprises substrate 11 having a layer of softenable material 13 coated thereon, the layer of softenable material 13 having a fracturable layer of migration marking material 14 contiguous with the upper surface of softenable layer 13. Particles of marking material 14 appear to be in contact with each other in the Figures due to the physical limitations of such schematic illustrations. The particles of marking material 14 are actually spaced less than a micrometer apart from each other. In the various embodiments, the supporting substrate 11 may be either electrically insulating or electrically conductive. In some embodiments the electrically conductive substrate may comprise a supporting substrate 11 having a conductive coating 12 coated onto the surface of a supporting substrate upon which the softenable layer 13 is also coated. The substrate 11 may be opaque, translucent, or transparent in various embodiments, including embodiments wherein the electrically conductive layer 12 coated thereon may itself be partially or substantially transparent. The fracturable layer of marking material 14 contiguous the upper surface of the softenable layer 13 may be slightly, partially, or substantially embedded in softenable material 13 at the upper surface of the softenable layer.

Figure 2:
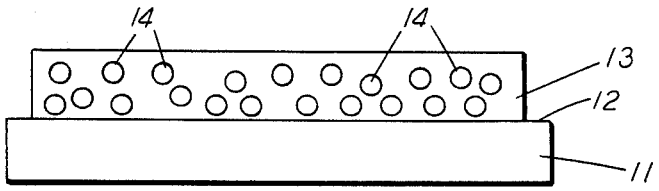
FIG. 2 is a partially schematic, cross-sectional view of a typical binder-structured migration imaging member.

In FIG. 2, migration imaging member 10 also comprises supporting substrate 11 having conductive layer 12 and softenable material layer 13 coated thereon. However, in this configuration, the migration marking material 14 is dispersed throughout softenable layer 13 in a binder-structured configuration. As in the layered configuration embodiment illustrated in FIG. 1, the substrate may be opaque, translucent, or transparent, electrically insulating or electrically conductive.

Figure 3:
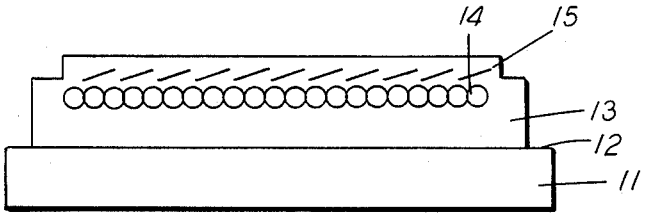
FIG. 3 is a partially schematic, cross-sectional view of a preferred embodiment of the novel overcoated migration imaging member of this invention.

In FIG. 3, a preferred embodiment of a novel multilayered overcoated structure of the present invention is shown wherein supporting substrate 11 has conductive coating 12 and a layer of softenable material 13 coated thereon. In the embodiment illustrated in FIG. 3, the migration marking material 14 is initially arranged in a fracturable layer contiguous the upper surface of softenable material layer 13. However, in other embodiments, the migration marking material 14 may be dispersed throughout softenable layer 13 as in the binder structure configuration illustrated in FIG. 2. In the preferred embodiment illustrated in FIG. 3, the migration imaging member also includes an advantageous overcoating layer 15 which is coated over a softenable layer 13. However, unlike the overcoated migration imaging members described in U.S. Pat. No. 3,909,262, a significant part of the overcoating layer 15 resides beneath the surface of the softenable layer 13. In the various embodiments of the novel migration imaging member of this invention, the overcoating layer 15 may comprise another layer or component of abhesive or release material.

Material suitable for use as substrate 11, conductive coating 12, softenable layer 13, and migration marking materials 14 are the same materials disclosed in U.S. Pat. No. 3,909,262 which is incorporated by reference herein in its entirety. As stated above, the substrate 11 may be opaque, translucent, transparent, electrically insulating or electrically conductive. Similarly, the substrate and the entire migration imaging member which it supports may be in any suitable form including a web, foil, laminate or the like, strip, sheet, coil, cylinder, drum, endless belt, endless moebius strip, circular disc or other shape. The present invention is particularly suitable for use in any of these configurations.

The conductive coating 12 may, like substrate 11, be of any suitable shape. It may be a thin vacuum deposited metal or metal oxide coating, a metal foil, electrically conductive particles dispersed in a binder and the like.

In various modifications of the novel migration imaging members of the present invention, the migration marking material may be electrically photosensitive, photoconductive, photosensitively inert, magnetic, electrically conductive, electrically insulating, or any other combination of materials suitable for use in migration imaging systems.

The softenable material 13 may be any suitable material which may be softenable by liquid solvents, solvent vapors, heat or combinations thereof. In addition, in many embodiments of the migration imaging member the softenable material 13 is typically substantially electrically insulating and does not chemically react during the migration force applying and developing steps of the present invention. It should be noted that, if conductive layer 12 is not utilized, layer 11 should preferably be substantially electrically conductive for the preferred modes thereof of applying electrical migration forces to the migration layer. Although the softenable layer has been described as coated on a substrate, in some embodiments, the softenable layer may itself have sufficient strength and integrity to be substantially self-supporting and may be brought into contact with a suitable substrate during the imaging process. It is particularly important that the softenable material be capable of swelling when contacted with a material applied before, during or after the deposition of the protective overcoating.

Any suitable swellable, softenable material may be utilized in layer 13. Typical swellable, softenable layers include styrene-acrylate copolymers, polystyrenes, alkyd substituted polystyrenes, styreneolefin copolymers, styrene-co-n-butylmethacrylate, a custom synthesized 80/20 mole percent copolymer of styrene and hexylmethacrylate having an intrinsic viscosity of 0.179 dl/gm; other copolymers of styrene and hexylmethacrylate, styrene-vinyltoluene copolymer, polyalphamethylstyrene, co-polyesters, polyesters, polyurethanes, polycarbonates, co-polycarbonates, mixtures and copolymers thereof. The above group of materials is not intended to be limiting, but merely illustrative of materials suitable for such softenable layers.

The overcoating layer 15 may be substantially electrically insulating, electrically conductive, photosensitive, photoconductive, photosensitively inert, or have any other desirable properties. For example, where the overcoating 15 is photoconductive, it may be used to impart light sensitivity to the imaging member through the techniques of xerographic technology. The overcoating 15 may also be transparent, translucent or opaque, depending upon the imaging system in which the overcoated member is to be used. The overcoating layer 15 is continuous and preferably of a thickness up to about 5 to 10 micrometers, although thicker overcoating layers may be suitable and desirable in some embodiments. For example, if the overcoating layer is electrically conductive, there are virtually no limitations on thickness, except for the practical ones of handling and economics. Preferably, the overcoating should have a thickness of at least about 0.1 micrometer and optimally, at least about 0.5 micrometer. Where the overcoating layer is electrically insulating and greater than about 5 to 10 micrometers thick, undesirably high potentials may have a greater tendency to build up upon the imaging member during processing and migration imaging. Insulating overcoatings of between about 1 micrometer and about 5 micrometers are preferred to minimize charge trapping in the bulk of the overcoating layer 15. Typical overcoating materials include acrylicstyrene copolymer, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, and the like. The overcoating layer 15 should protect the softenable layer 13 in order to provide greater resistance to the adverse effects of abrasion. The overcoating layer 15 may adhere strongly to the softenable layer 13 to assist the migration imaging member to survive adhesive tape removal without damage. The overcoating layer 15 may also have abhesive properties at its outer surface which provide improved insensitivity to fingerprints and blocking, and which further improve the capability of the migration imaging member to withstand adhesive tape removal. The adhesive properties may be inherent in the overcoating layer 15 or may be imparted to the overcoating layer 15 by incorporation of another layer or component of abhesive material. It will be appreciated that these overcoating layers protect the migration imaging members before imaging, during imaging and (with other than liquid development techniques) after the members have been imaged.

The overcoatings should permit charge transport through the overcoating layer 15 and most importantly across the overcoating/softenable layer interface at least during heat development of the latent image on the member, and possess various other properties which allow the migration imaging process of the present invention to be performed satisfactorily. For vapor development, the overcoating layer 15 must permit solvent vapor to penetrate to the softenable layer 13 to facilitate charge transport and to soften the softenable layer for particle migration. For heat development, the overcoating layer 15 must allow charge transport first through the bulk of the overcoating layer 15 and second most crucially across the overcoating layer/softenable layer interface either before or at least during the early stage of heating. While the first requirement can be met with many overcoating materials, the second requirement imposes very severe restrictions because of the usual existence of a sharp blocking interface between the overcoating layer and the softenable layer. The blocking interface causes significant trapping of the injected surface charge until the later stage of heat development. Therefore, the photosensitive particles are subjected to the combined effects of a high field and high temperature which causes excessive thermally activated conduction within the unexposed particles analogous to the photoconduction within the exposed particles. As a result, the discrimination (contrast density) between light struck and dark regions is degraded. In the present invention, interfacial charge transport is greatly enhanced by the formation of a boundary zone between the softenable layer 13 and overcoating layer 15, schematically illustrated in FIGS. 4A through 4D as diagonal lines. The overcoating layer 15 may also impart the added advantage of extending the room temperature charge life of the migration imaging member without adversely affecting the photographic characteristics. While the charge life of unovercoated, heat developed migration imaging members is often only about two minutes, this may be extended to many hours by the overcoating layer 15 of the present invention. In preparing the boundary zone for the overcoated migration imaging members of this invention, it is important that at least the surface of the softenable layer spaced from, i.e. opposite, the substrate be swelled prior to, during or after application of the overcoating layer 15. This swelling allows penetration of a portion of the overcoating layer 15 into the swollen surface of the softenable layer 13. Swelling of the softenable layer is effected with a fluid applied prior to, during or after application of the overcoating layer 15. The fluid is a partial solvent for the softenable layer material and may be removable or form an integral part of the overcoating layer 15. The partial solvent should soften or swell, but not significantly dissolve, at least the surface of the softenable layer to allow the overcoating layer material to penetrate between about 20 Angstroms to about 1,000 Angstroms into the surface of the softenable layer. The equilibrium penetration depth of one polymer into another can be calculated from the Flory-Huggins $X_{AB}$ parameter for the two polymers A and B. (E. Helfand, Accounts of Chemical Research 8, 295 (1975)). The penetration depths for several polymer combinations have been tabulated. (E. Helfand and A. M. Sapse, J. Chem. Phys. 62 (4), 1327 (1975)). In general, the thickness of the interface is a measure of compatibility. In other words, the thicker the interface or boundary zone, the lower the interfacial tension and therefore the better the adhesion. A thicker interface or boundary zone promotes better charge transport with less interfacial trapping. The penetration of the overcoating increases its resistance to being peeled off as well. This penetration of at least about 20 Angstroms of the overcoating layer material into the softenable layer is particularly important when the migration imaging member is to be used in heat development processes because it minimizes interfacial charge trapping between the softenable layer and the overcoating layer. As mentioned above, if trapped charges are allowed to remain at this interface for a significant time during heating, the migration imaging particles are subject to a combination of high temperature and field. This leads to electron-hole separation in the migration imaging particles, just as it occurs during light exposure. Thus, the discrimination between exposed and unexposed areas is degraded. Trapping of charge at the interface may be determined from thermally-stimulated current measurements. Thus charge trapping at the interface causes an undesirable degradation of contrast in the final imaged member. Although U.S. Pat. No. 3,909,262 utilizes overcoating layers on softenable layers, it is believed that none of the solvents for the overcoating layers disclosed in the patent will sufficiently soften or swell the softenable layer to allow penetration of the overcoating material to a depth of at least about 20 Angstroms into the softenable layer. One may readily determine whether a liquid is a partial solvent which will soften or swell imaging layer material by solubility experiments. The extent of penetration of the swollen or softened softenable layer by overcoating layer materials can be determined by sectional examination under an electron microscope. Typical combinations of partial solvents and softenable layers swellable by the partial solvents include custom synthesized 80/20 mole percent copolymer of styrene and hexylmethacrylate, having a weight average molecular weight of about 45,000 or other styrene copolymers, methacrylic copolymers, etc., and a fluorinated hydrocarbon liquid (Freon TF, available from E. I duPont de Nemours and Company), methanol, polydimethylsiloxane, isopropyl alcohol, Isopar G, etc., and mixtures thereof.

As indicated above, the partial solvent may be applied to the softenable layer prior to, simultaneously with or after application of the overcoating layer material. The partial solvent may be applied in the form of a liquid or vapor. The partial solvent may also be a solvent for the overcoating layer materials. It should not, of course, chemically degrade the overcoating of softenable layer materials. The overcoating materials should be deposited on the softenable layer surface while the surface is in a softened or swollen condition to allow penetration of the overcoating layer material into and below the outer surface of the softenable layer opposite the substrate.

If desired, the partial solvent may be admixed with the overcoating layer material and applied simultaneously therewith to the surface of the softenable layer. Simultaneous application is desirable because it eliminates a separate partial solvent treatment step. The partial solvent may perform a plurality of different functions. For example, in addition to serving as partial solvent for the softenable layer material, it may also act as a solvent for the film forming resin components of the overcoating layer and even provide abhesive properties to the exposed surface of the overcoating layer. If desired, abhesive materials which do not soften or swell the softenable layer may be added to the overcoating mixture to impart blocking resistance, and release properties and fingerprint resistance to the overcoating. These abhesive materials should not degrade the film forming components of the overcoating and should preferably have a surface energy of less than about 20 ergs/cm$^2$. Typical abhesive materials include fatty acids, salts and esters, fluorocarbons, silicones and the like. The coatings may be applied by any suitable technique such as draw bar, spray, dip, melt, extrusion or gravure coating. The partial solvent for the softenable layer may also be mixed together with the film forming resin as a dispersion or emulsion. Outstanding results have been achieved when the softenable layer contains a copolymer of styrene and hexylmethacrylate and the overcoating layer comprises an acrylicstyrene copolymer and polydimethylsiloxane. No significant degradation and contrast density difference between the final images were observed for imaging members having this overcoating when compared with non-overcoated imaging members when imaged by negative corona charging, imagewise exposure and heat development. Moreover, this overcoated member exhibited excellent resistance to the adverse effects of finger prints abrasion. Further, the overcoated member could be wound into rolls without blocking and was not damaged when Scotch brand adhesive tape was applied to the image surface and thereafter removed by rapid stripping. While the charge life of a heat developed non-overcoated migration imaging member is about two minutes, the charge life of the overcoated member of this invention is extended to many hours.

The improved imaging members of the present invention described above are useful in the imaging process illustrated in FIG. 4. The imaging steps in the process using the novel imaging members of the present invention typically comprise the steps of forming an electrical latent image on the imaging member and developing the latent image by decreasing the resistance of the softenable material to allow migration of the particulate marking material through the softenable layer 13 whereby migration marking material is allowed to migrate in depth in softenable material layer 13 in an imagewise configuration. The imaging member illustrated in FIG. 4 is a layered configuration imaging member like that illustrated in FIG. 3. However, binder structured imaging members such as illustrated in FIG. 2 and as described in conjunction with FIG. 3 may also be used in the imaging process illustrated in FIG. 4.

Any suitable method of forming an electrical latent image upon the imaging member may be used in the process. For example, the surface of the imaging member may be electrically charged in imagewise configuration by various modes including charging or sensitizing in image configuration by means of a mask or stencil or by first forming such a charge pattern on a separate layer such as a photoconductive insulating layer used in conventional xerographic reproduction techniques and then transferring the charge pattern to the surface of a migration imaging member by bringing the two into very close proximity and utilizing transfer techniques as described, for example, in U.S. Pat. No. 2,982,647, U.S. Pat. No. 2,852,814, and U.S. Pat. No. 2,937,943. In addition, charge patterns confirming to selected shaped electrodes or combinations of electrodes may be formed on a support surface or combinations of electrodes may be formed on a support surface by the TESI discharge technique, as more fully described in U.S. Pat. Nos. 3,023,731 and 2,919,967; or by techniques described in U.S. Pat. No. 3,001,848; or by induction imaging techniques, or even by electron beam recording techniques as described in U.S. Pat. No. 3,113,179.

Figure 4A:
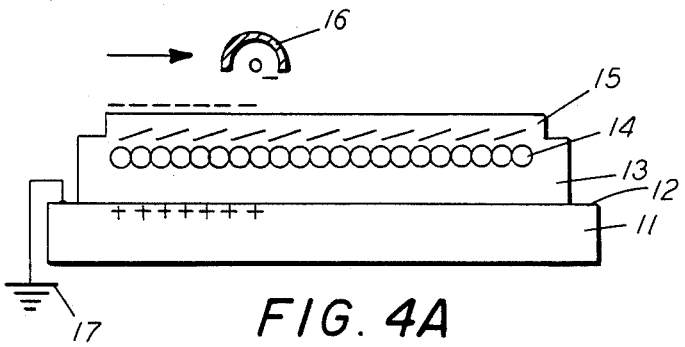
FIG. 4 illustrates in partially schematic, cross-sectional views, the process steps in the preferred embodiments of the present invention.
Figure 4B:
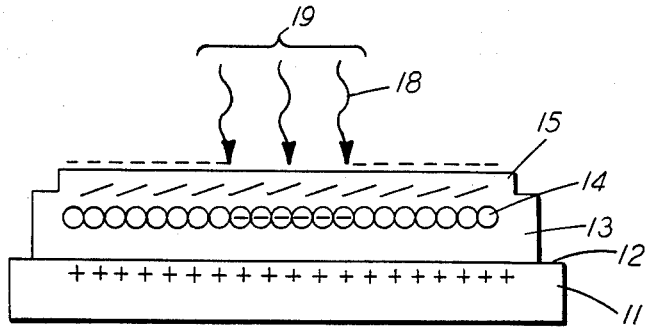

When the migration marking material or softenable material is an electrically photosensitive material, the electrical latent image may be formed on the imaging member by electrostatically charging the member and then exposing the charged member to activating electromagnetic radiation in an imagewise pattern. This is a method illustrated in FIGS. 4A and 4B. In FIG. 4A, the imaging member of the present invention comprising substrate 11 having conductive coating 12 thereon, softenable layer 13, a fracturable layer of marking material 14 contiguous the surface of the softenable layer 13 and overcoating 15 thereon is shown being electrostatically charged with corona charging device 16. Where substrate 11 is conductive or has a conductive coating 12, the conductive layer is grounded as shown at 17 or maintained at a predetermined potential during electrostatic charging. Another method of electrically charging such a member is to electrostatically charge both sides of the member to surface potentials of opposite polarities. In FIG. 4B, the charged member is shown being exposed to activating electromagnetic radiation 18 in area 19 thereby forming an electrical latent image upon the imaging member.

Figure 4C:
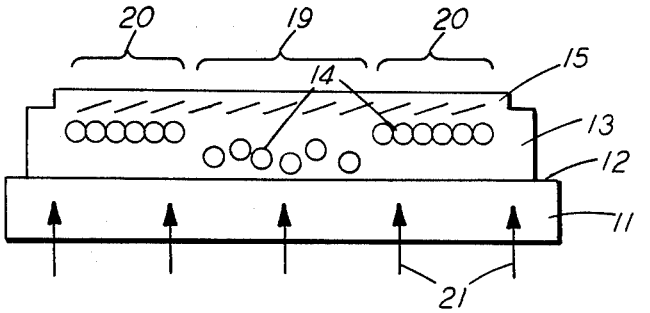

The member having the electrical latent image thereon is then developed by decreasing the resistance of the softenable material to migration of the particulate marking material, through the softenable layer 13 as shown in FIG. 4C by application of heat shown radiating into the softenable material at 21 to effect softening. The application of heat, solvent vapors, or combinations thereof, or any other means for decreasing the resistance of the softenable material of softenable layer 13 to allow migration of the migration marking material may be used to develop a latent image by allowing migration marking material 14 to migrate in depth in softenable layer 13 in imagewise configuration. In FIG. 4C, the migration marking material is shown migrated in area 19 and in its initial, unmigrated state in areas 20. The areas 19 and 20 correspond to the formation of the electric latent image described in conjunction with FIGS. 4A and 4B. Depending upon the specific imaging system used, including the specific imaging structure, materials, process steps, and other parameters, the imaging member of the present invention may produce positive images from positive originals or negative images from positive originals. The migrated, imaged member illustrated in FIG. 4C is shown with the overcoating layer 15 thereon. This overcoating layer 15 protects the imaging member prior to, during and after imaging.

In the development step illustrated in FIG. 4C, the imaging member is typically developed by uniformly heating the structure to a relatively low temperature. For example, at a temperature of 110° C. to about about 130° C., heat need only be applied for a few seconds. For lower heating temperatures, more heating time may be required. When the heat is applied, the softenable layer 13 decreases in viscosity thereby decreasing its resistance to migration of the marking material in depth through the softenable layer and, as shown in FIG. 4C, migrating in the exposed area 19.

Figure 4D:
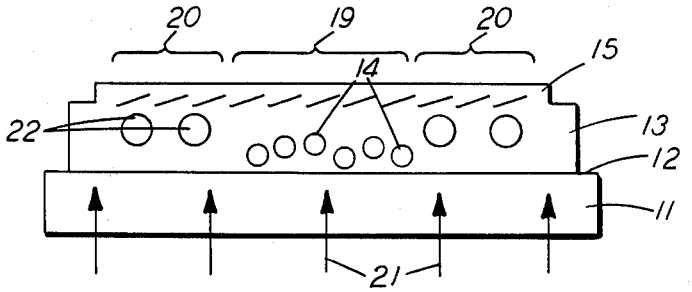

In addition to marking material particle migration, under some conditions, an advantageous fusing or agglomeration effect illustrated in FIG. 4D may occur whereby unmigrated marking particles fuse or agglomerate to form larger particles 22 which typically are maintained near the surface of the softenable material 13. As before, it is noted that the particles which have been exposed to light in areas 19 are migrated away from the overcoating layer-softenable layer interface and do not fuse or agglomerate because they are no longer in close proximity to one-another. The image formed by the development steps illustrated in FIG. 4D using vapor followed by heat are highly light transmitting because of the agglomeration or selective fusing of the migration marking material.

Thus, the novel imaging structure and the absence of any significant degradation in contrast density of this invention offers a significant improvement for heat development systems. At the same time, this migration imaging member also exhibits enhanced resistance to blocking, abrasion and finger prints.

The invention will now be described in detail with respect to specific preferred embodiments thereof, it being noted that these examples are intended to be illustrative only and are not intended to limit the scope of the present invention. Parts and percentages are by weight unless otherwise indicated.

EXAMPLE I

An imaging member similar to that illustrated in FIG. 3 was prepared by applying about a 20 percent by weight mixture of about 80/20 mole percent copolymer of styrene and hexylmethacrylate dissolved in toluene by means of a No. 8 draw rod onto about a 3 mil Mylar polyester film (available from E. I. duPont DeNemours Co.) having a thin, semi-transparent aluminum coating. The deposited softenable layer was allowed to dry on a heat block at about 90° C. for about 5 minutes. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. The resulting migration imaging member was thereafter imaged and developed by heat processing techniques comprising the steps of corotron charging to a surface potential of about −100 volts, exposing to activating radiation through a step-wedge and developing by heating to about 115° C. for about 5 seconds on a hot plate in contact with the Mylar. Contrast density of the imaged member was about 1.2 when the time interval between charging and exposure was less than about two minutes. The Thermally Stimulated Discharge Current (TSC) was measured in order to demonstrate the importance of interfacial charge trapping by comparison with the TSC of overcoated imaging members provided in Examples II and III. TSC measurements were carried out utilizing an aluminum pick-up electrode of about 1.75 inches in diameter spaced about 0.125 inches above the top surface of the charged migration imaging member resting on an aluminum plate. The temperature of the migration imaging member was raised at a heating rate of about 10° C./min. and the external current caused by the induced charge on the pick-up electrode was monitored as a function of temperature. By interpreting the resulting current versus temperature curve, information was obtained regarding the charge transport properties of the migration imaging member during heat development. The degree of interfacial charge trapping was indicated by the intensity of a peak of about $2.2\times10^{-12}$ amps at about 65° C. in the TSC measurements. When the time delay between the charging and exposing steps was about 3 minutes, the contrast density was degraded to about 1.0. Unfortunately, the resulting imaged migration imaging member exhibited poor abrasion when scraped with a finger nail and inferior finger print resistance which appeared as imaged finger prints on the imaged member. The integrity of the softenable layer of the migration imaging member failed when subjected to a very moderate adhesive-tape test with Scotch brand "Magic" adhesive tape in which the tape is applied to the imaged member and slowly peeled off with the peeled end of the tape being moved toward the other end of the tape still adhering to the member. The process of this example was conducted to provide a control for purposes of comparison with the migration imaging system of the instant invention.

EXAMPLE II

A fresh imaging member was prepared as described in Example I. An aqueous emulsion of a copolymer of about 30–40 percent by weight styrene and about 70–60 percent by weight butylmethacrylate (Neocryl A-622 available from Polyvinyl Chemical Industries) having a glass transition temperature of about 45° C. was applied to the copolymer layer of styrene and hexylmethacrylate by means of a No. 14 draw rod after selenium deposition. The emulsion had a viscosity of about 300 centipoises and contained about 17 percent by weight solids, about 57 percent by weight water, about 20 percent by weight ethanol and about 6 percent by weight butyl cellusolve. The resulting overcoated migration imaging member was dried at about 70° C. for about 5 minutes to form an overcoating having a thickness of about 1–2 micrometers and a Knoop hardness of about 8.9. The Knoop hardness number is determined by ASTM Standard Test D1474 used for measuring the indentation hardness of organic coatings. It was thereafter imaged and developed by heat processing techniques similar to those described in Example I comprising the steps of corotron charging to a surface potential of about 200 volts to form a field within the migration imaging member similar to that in Example I, immediately exposing to activating radiation through a step-wedge and developing by heating to about 115° C. for about 5 seconds on a hot plate in contact with the Mylar. The resulting imaged migration imaging member exhibited excellent abrasion resisance when scraped with a finger nail and good finger print resistance when attempts were made to apply fingerprints to the imaging member before and after imaging. Unfortunately, contrast density degraded to about the 0.8–0.9 range. The TSC measurement showed a greater degree of interfacial charge trapping (as compared with the TSC of Example I) as indicated by an enhanced peak of about $4.8\times10^{-12}$ amps at 65° C. In addition, when the time delay between charging and exposing steps was about 10 hours, no additional degradation of contrast density was observed. The integrity of the overcoated migration imaging member remained unchanged when subjected to a relatively severe adhesive-tape test in which Scotch brand "Magic" adhesive tape was applied to the imaged member and rapidly peeled off with the peeled end of the tape being moved perpendicularly to the overcoating surface. The process of this example was conducted to provide a control for purposes of comparison with the migration imaging system of the instant invention.

EXAMPLE III

A fresh imaging member was prepared as described in Example I. About 1.6 percent by weight of solids of low molecular weight polydimethylsiloxane (Byk-301 available from Byk-Mallinckrodt) was added to the aqueous emulsion of the acrylic-styrene copolymer (Neocryl A-622 available from Polyvinyl Chemical Industries) described in Example II. The resulting emulsion was applied to the copolymer layer of styrene and hexylmethacrylate after selenium deposition and dried as described in Example II to form an overcoating having a thickness of about 1 to 2 micrometers. Due to swelling of the surface of the softenable layer by the polydimethylsiloxane, a portion of the acrylic-styrene copolymer penetrated and extended more than about 20 Angstroms beneath the surface of the softenable layer. The resulting overcoated migration imaging member was thereafter imaged and developed by the heat processing techniques described in Example I comprising the steps of corotron charging to a surface potential of about −200 volts, immediately exposing to activating radiation through a stp-wedge and developing by heating to about 115° C. for about 5 seconds on a hot plate in contact with the Mylar. The resulting imaged migration imaging member exhibited excellent abrasion resistance when scraped with a finger nail and excellent finger print resistance when attempts were made to apply fingerprints to the imaging member before and after imaging. The overcoated migration imaging member also retained its integrity when subjected to a very severe adhesive-tape test with Scotch brand "Magic" adhesive tape similar to that described in Example II but where tape removal was very rapid. Excellent contrast density of about 1.1 was obtained. The improved performance under the tape test was due to the excellent release properties imparted by the polydimethylsiloxane. This contrast density was almost identical to that obtained with the nonovercoated migration imaging member described in Example I. The TSC measurement corroborates this result, i.e. the peak of about $2.1\times10^{-12}$ amps at about 65° C. was of about the same intensity as in Example I. A comparison of the results of this Example with those obtained in the preceding Examples clearly demonstrates that the imaging member and process of preparing it in this Example are clearly superior to those described in Examples I and II.

EXAMPLE IV

The procedures of Example III were repeated with identical materials except that the time interval between charging and exposure was extended to about 10 hours. Results identical to those described in Example III were achieved.

EXAMPLE V

An imaging member similar to that illustrated in FIG. 3 was prepared by applying about a 20 percent by weight mixture of about 80/20 mole percent copolymer of styrene and hexylmethacrylate dissolved in toluene by means of a No. 8 draw rod onto about a 3 mil Mylar polyester film (available from E. I. duPont deNemours Co.) having a thin, semi-transparent aluminum coating. The coated structure was allowed to dry on a heat block at about 90° C. for about 5 minutes. The temperature of the copolymer was raised to about 115° C. to lower the viscosity of the exposed surface of the copolymer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. About 5 percent by weight of methacrylate polymer (Neocryl B-700 available from Polyvinyl Chemical Industries) dissolved in about 95 percent by weight of fluorinated hydrocarbon (Freon TF available from E. I. duPont deNemours Co.) was applied to the copolymer layer of styrene and hexylmethacrylate with a wire-wound rod (Mayer 14) and dried at about 110° C. for about 15 seconds on a heat block to form a 1 to 2 micrometer thick overcoating. Due to swelling of the surface of the softenable layer by the fluorinated hydrocarbon, a portion of the methacrylate polymer penetrated and extended more than about 20 Angstroms beneath the surface of the softenable layer. The dried overcoating had a Knoop hardness of about 10. The overcoated migration imaging member was thereafter imaged and developed by heat processing techniques comprising the steps of corotron charging to a surface potential of about −200 volts, exposing to activating radiation through a step-wedge and developing by heating to about 115° C. for about 5 seconds on a hot plate in contact with the Mylar. The resulting imaged migration imaging member exhibited excellent abrasion and fingerprint resistance and the overcoating layer adhered well to the softenable layer. The overcoated migration imaging member failed to retain its integrity when subjected to the relatively severe adhesive-tape test with Scotch brand "Magic" adhesive tape described in Example II. However, an excellent contrast density of about 1.1 was obtained. This contrast density was almost identical to that obtained with the nonovercoated migration imaging member described in Example 1. A comparison of the results acheived in this Example with those obtained in the preceding Examples clearly demonstrates that the imaging member and process of preparing it in this Example are clearly superior to those described in Examples I and II.

EXAMPLE VI

An imaging member similar to that illustrated in FIG. 3 was prepared by the procedures and materials of Example V except that about 0.5 percent by weight of solids of intermediate molecular weight polydimethylsiloxane (Scientific Polymer Products 145-S, lot #04) was added to the methacrylate overcoating mixture and a severe adhesive tape test as described in Example III was used. Results substantially identical to those in Example V were obtained except that the migration imaging member retained its integrity under the adhesive tape test described in Example V.

EXAMPLE VII

An imaging member similar to that illustrated in FIG. 3 was prepared by applying about a 20 percent by weight mixture of about 80/20 mole percent copolymer of styrene and hexylmethacrylate dissolved in toluene by means of a No. 8 draw rod onto about a 3 mil Mylar polyester film (available from E. I. duPont deNemours Co.) having a thin, semi-transparent aluminum coating. The coated structure was allowed to dry on a heat block at about 90° C. for about 5 minutes. The temperature of the copolymer was raised to about 115° C. to lower the viscosity of the exposed surface of the copolymer to about $5\times10^3$ poises in preparation for the deposition of marking material. A thin layer of particulate vitreous selenium was then applied by vacuum deposition in a vacuum chamber; maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. About 5 percent by weight of an methacrylate copolymer (Neocryl B-705 available from Polyvinyl Chemical Industries) dissolved in about 95 percent by weight of fluorinated hydrocarbon (Freon TF available from E. I. duPont deNemours Co.) was applied to the copolymer layer of styrene and hexylmethacrylate with a wire-wound rod (Mayer 14) and air dried at room temperature for about 24 hours to form an overcoating having a thickness of about 1–2 micrometers. Due to swelling of the surface of the softenable layer by the fluorinated hydrocarbon, a portion of the acrylic-styrene copolymer penetrated and extended more than about 20 Angstroms beneath the surface of the softenable layer. The dried overcoating had a Knoop hardness of about 12. The overcoated migration imaging member was thereafter imaged and developed by heat processing techniques comprising the steps of corotron charging to a surface potential of about −200 volts, exposing to activating radiation through a step-wedge and developing by heating to about 115° C. for about 5 seconds on a hot plate in contact with the Mylar. The resulting imaged migration imaging member exhibited excellent abrasion and fingerprint resistance and the overcoating layer adhered well to the softenable layer. The overcoated migration imaging member retained its integrity when subjected to a relatively severe adhesive-tape test with Scotch brand "Magic" adhesive tape as described in Example II. Excellent contrast density of about 1.1 was obtained. This contrast density was almost identical to that obtained with the nonovercoated migration imaging member described in Example 1. A comparison of the results achieved in this Example with those obtained in the preceding Examples clearly demonstrates that the imaging member and process of preparing it in this Example are clearly superior to those described in Examples I and II.

EXAMPLE VIII

An imaging member similar to that illustrated in FIG. 3 was prepared by the procedures and materials of Example VII except that the overcoating was dried on a block heater at about 120° C. for about 20 seconds. Results substantially identical to those in Example VII were obtained.

EXAMPLE IX

An imaging member similar to that illustrated in FIG. 3 was prepared by the procedures and materials of Example VII except that about 0.3 percent by weight based on the total weight of overcoating solids of intermediate molecular weight polydimethylsiloxane (Scientific Polymer Products 145-S, lot #04) was added to the methacrylate overcoating mixture. A severe adhesive tape test as described in Example III was employed. Results substantially identical to those in Example VII were obtained.

Other modifications of the present invention will occur to those skilled in the art based upon a reading of the present disclosure. These are intended to be included within the scope of this invention.

What is claimed is:

1. A process for preparing a migration imaging member comprising providing a substrate, forming an electrically insulating, swellable, softenable layer on said substrate, said softenable layer having migration marking material located at least at or near the surface of said softenable layer spaced from said substrate, applying a material which swells at least said surface of said softenable layer, and applying a protective overcoating forming mixture comprising a film forming resin to said softenable layer, said softenable layer being sufficiently swollen by said material which swells said surface of said softenable layer to allow part of said film forming resin to penetrate said softenable layer to a depth of at least about 20 Angstroms to form a boundary zone comprising material from said softenable layer and said film forming resin while said softenable layer is swollen.

2. A process for preparing a migration imaging member in accordance with claim 1 wherein said film forming resin and said material which swells at least said surface of said softenable layer are simultaneously applied to said softenable layer.

3. A process for preparing a migration imaging member in accordance with claim 1 wherein said material which swells at least said surface of said softenable layer is a fluorinated hydrocarbon liquid.

4. A migration imaging member comprising a substrate, an electrically insulating swellable, softenable layer on said substrate, said softenable layer having migration marking material located at least at or near the surface of said softenable layer spaced from said substrate, and a protective overcoating comprising a film forming resin, a part of which extends beneath said surface of said softenable layer to a depth of at least about 20 Angstroms to form a boundary zone comprising material from said softenable layer and said film forming resin.

5. A migration imaging member in accordance with claim 4 wherein said part of said film forming resin extends beneath said surface of said softenable layer to a depth of between about 20 Angstroms and about 1,000 Angstroms.

6. An imaging method comprising providing a migration imaging member comprising a substrate, an electrically insulating, swellable, softenable layer on said substrate, said softenable layer having migration marking material located at least at or near the surface of said softenable layer spaced from said substrate, and a protective overcoating comprising a film forming resin, a part of which extends beneath said surface of said softenable layer to a depth of at least about 20 Angstroms to form a boundary zone comprising material from said softenable layer and said film forming resin, electrostatically charging said member, exposing said member to activating radiation in an imagewise pattern and developing said member by decreasing the resistance to migration of marking material in depth in said softenable layer at least sufficient to allow migration of marking material whereby marking material migrates toward said substrate in image configuration.

7. An imaging method in accordance with claim 6 including decreasing said resistance to migration of marking in depth in said softenable layer by heat softening said softenable layer.

8. An imaging method in accordance with claim 7 including exposing said member to activating radiation in an imagewise pattern at least three minutes after said electrostatic charging.

9. An imaging method in accordance with claim 6 wherein said part of said film forming resin extends beneath said surface of said softenable layer to a depth between about 20 Angstroms and about 1,000 Angstroms.

* * * * *